US008656596B2

(12) United States Patent
Holcomb et al.

(10) Patent No.: US 8,656,596 B2
(45) Date of Patent: Feb. 25, 2014

(54) CUTTING AND SHARPENING DEVICE AND METHOD

(75) Inventors: David A. Holcomb, Seattle, WA (US); Matthew Krus, Seattle, WA (US)

(73) Assignee: Chef'n Corporation, Seattle, WA (US)

( * ) Notice: Subject to any disclaimer, the term of this patent is extended or adjusted under 35 U.S.C. 154(b) by 257 days.

(21) Appl. No.: 13/019,898

(22) Filed: Feb. 2, 2011

(65) Prior Publication Data

US 2011/0192034 A1 Aug. 11, 2011

Related U.S. Application Data

(60) Provisional application No. 61/303,434, filed on Feb. 11, 2010.

(51) Int. Cl.
*B26B 11/00* (2006.01)

(52) U.S. Cl.
USPC ..... 30/138; 30/139

(58) Field of Classification Search
USPC ..... 30/138, 139
See application file for complete search history.

(56) References Cited

U.S. PATENT DOCUMENTS

| | | | | | |
|---|---|---|---|---|---|
| 1,047,429 | A | * | 12/1912 | Meyer | 30/139 |
| 1,244,055 | A | * | 10/1917 | Komow | 30/139 |
| 1,271,522 | A | * | 7/1918 | Bortman | 30/139 |
| 1,319,707 | A | * | 10/1919 | Zawistowski | 30/139 |
| 1,338,478 | A | * | 4/1920 | Zawistowski | 30/139 |
| 1,418,053 | A | | 5/1922 | Baumann, Jr. | |
| 1,559,724 | A | * | 11/1925 | Meader et al. | 30/138 |
| 1,666,643 | A | | 4/1928 | Edelman | |
| 1,957,776 | A | * | 5/1934 | Gury | 451/422 |
| 2,033,939 | A | * | 3/1936 | Jeppsson | 30/139 |
| 3,562,907 | A | | 2/1971 | Greenberg | 30/233 |
| 3,783,513 | A | | 1/1974 | Escoe | 30/273 |
| 4,062,111 | A | * | 12/1977 | Clark | 30/139 |
| 5,311,664 | A | | 5/1994 | Abdul | 30/276 |
| 6,502,313 | B1 | | 1/2003 | Bilodeau | 30/292 |
| 2011/0192034 | A1 | * | 8/2011 | Holcomb et al. | 30/138 |
| 2012/0011726 | A1 | * | 1/2012 | Lu | 30/138 |

FOREIGN PATENT DOCUMENTS

WO 2006093482 A1 9/2006

* cited by examiner

*Primary Examiner* — Hwei C Payer
(74) *Attorney, Agent, or Firm* — Seed IP Law Group PLLC

(57) ABSTRACT

A cutting and sharpening device includes a body, a blade element having a cutting edge and rotatably mounted with respect to the body, and a sharpening tool configured to be removably coupled to the body. The sharpening tool can be selectively moved between a first position in which the sharpening tool is spaced from the blade element and a second position in which the sharpening tool contacts the blade element adjacent the cutting edge. The device can be used as a rolling cutter or slicer, and as a sharpening device that sharpens the blade element when the sharpening tool is coupled to the body. The sharpening tool can sharpen the cutting edge when it is in the second position and the blade element is rotated or rolled, directly or indirectly, on a surface.

4 Claims, 10 Drawing Sheets

CUTTING AND SHARPENING DEVICE AND METHOD

BACKGROUND

1. Technical Field

The present disclosure is directed to tools, such as kitchen or cooking tools, and more particularly, to a rolling cutting device with a blade sharpening feature.

2. Description of the Related Art

Cutting and slicing devices are frequently used in the kitchen for food preparation or in workshops for various cutting needs. Despite improvements in blade material and durability, blades continue to require sharpening after a duration of use. Typically, sharpening devices are separate devices with an abrasive and/or hard material that is rubbed or stroked against the blade cutting edge to sharpen it. This requires a user to hold the blade or the sharpening device and manually move it with respect to the other of the blade or sharpening device. This task is laborious and results in inconsistent sharpening in different regions of the cutting edge.

Sharpening is even more difficult and tedious for cutting devices that are mounted to a body and cut by moving or rolling of the blade with respect to the body. Examples of such devices include rolling cutters, such as rolling blades used to cut pizza or other food items into multiple pieces. The blade is generally rotatably coupled to a handle, allowing a user to roll the blade and easily cut through food items. However, it is awkward and tedious to sharpen the blade in these devices because the blade is not fixed with respect to the handle and therefore, the user has to grip the blade to sharpen small regions or sections of the cutting edge one region or section at a time.

SUMMARY OF THE INVENTION

In particular embodiments, a cutting device incorporates a body, a blade element, and a sharpening tool. The blade element has a cutting edge and is rotatably mounted with respect to the body. The sharpening tool is configured to be coupled to the body. The sharpening tool is selectively movable between a first position in which the sharpening tool is spaced from the blade element and a second position in which the sharpening tool contacts the blade element at or adjacent the cutting edge. The sharpening tool can sharpen the cutting edge when in the second position and the blade element is rotated.

In other embodiments, a cutting and sharpening device having a blade element is selectively configurable to cut an object and to sharpen the blade element. The device incorporates a body, the blade element, an arm, and an actuator. The body is configured to allow a user to operate the device. The arm extends from the body and rotatably couples the blade element to the body. The blade element is rollable on the object to cut the object. The actuator assembly includes at least an actuating portion and at least one sharpening tool. The actuator assembly is configured to be removably coupled to the body and can be selectively moved from an idle position to a sharpening position. The sharpening tool contacts the blade element proximate a cutting edge when the actuator assembly is coupled to the body and in the sharpening position. A rotating adaptor is configured to be removably coupled with respect to the blade element to rotate therewith. The rotating adaptor is rotatable on a surface at least when the actuator assembly is in the sharpening position to sharpen the blade element.

In still other embodiments, a cover for a pizza cutter incorporates a protective cover and a sharpener. The protective cover is sized and shaped to engage a blade on the pizza cutter and to prevent a cutting edge of the blade from contacting other objects. The protective cover is configured to rotate as a unit with the blade when coupled hereto. The sharpener is coupled to the protective cover and movable between an idle position in which it is spaced apart from the blade and a sharpening position in which it contacts the cutting edge. The sharpener is configured to remain fixed with respect to a handle on the pizza cutter such that the blade can move with respect to the sharpener.

DETAILED DESCRIPTION

Figure 1A:
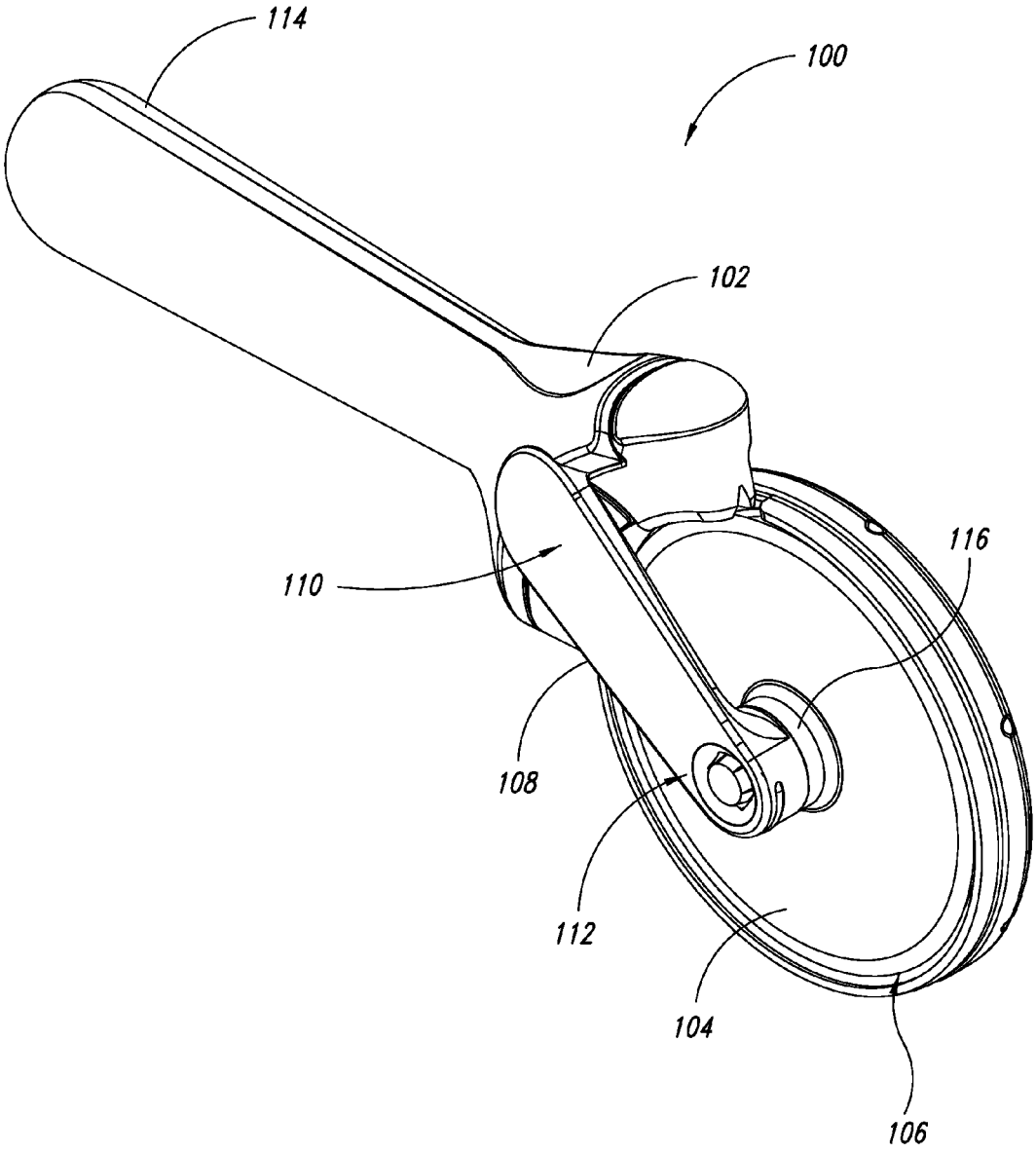
FIG. 1A illustrates an isometric view of a cutting device according to one embodiment.
Figure 1B:
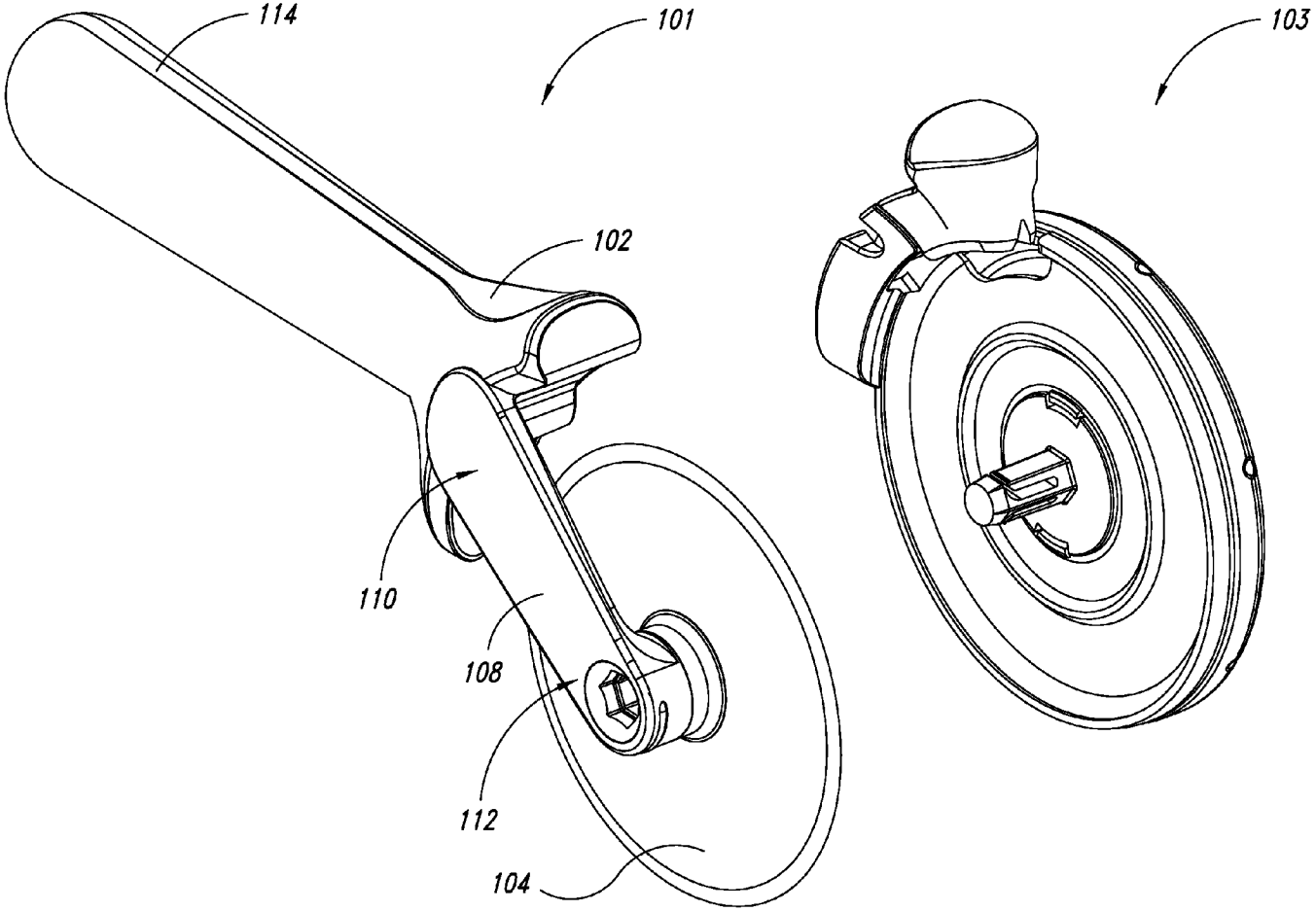
FIG. 1B illustrates an isometric view of a cutting assembly and a sharpening assembly of a cutting device according to one embodiment.

FIG. 1A illustrates a cutting device 100 according to one embodiment. In one aspect, the cutting device 100 can be selectively transformed between a cutting state and a sharpening state. As illustrated in FIG. 1B, the cutting device 100 can include a cutting assembly 101 and a sharpening assembly 103.

In one embodiment, the cutting assembly 101 includes a body 102 and a blade element 104 rotatably mounted to or with respect to the body 102 and including a cutting edge 106 configured to cut a substrate, such as a food item (not shown).

For example, the blade element 104 can be rotatably mounted with respect to the body 102 via an arm 108 having a first end region 110 fixedly coupled to the body 102 and a second end region 112 extending toward a central region of the blade element 104, the blade element 104 being rotatably coupled to the second end region 112. In some embodiments, the device 100 and/or body 102 includes a handle 114 configured to adapt or conform to a user's grip, assisting in rolling of the blade element 104 over the food item.

In one aspect, the arm 108 can be coupled to the blade element 104 with a first coupling member 116 that is rotatably coupled to the second end region 112 of the arm 108 and fixedly coupled to the blade element 104. In another embodiment, the first coupling member 116 can be fixedly coupled to the second end region 112 and roratably coupled to the blade element 104.

Figure 2:
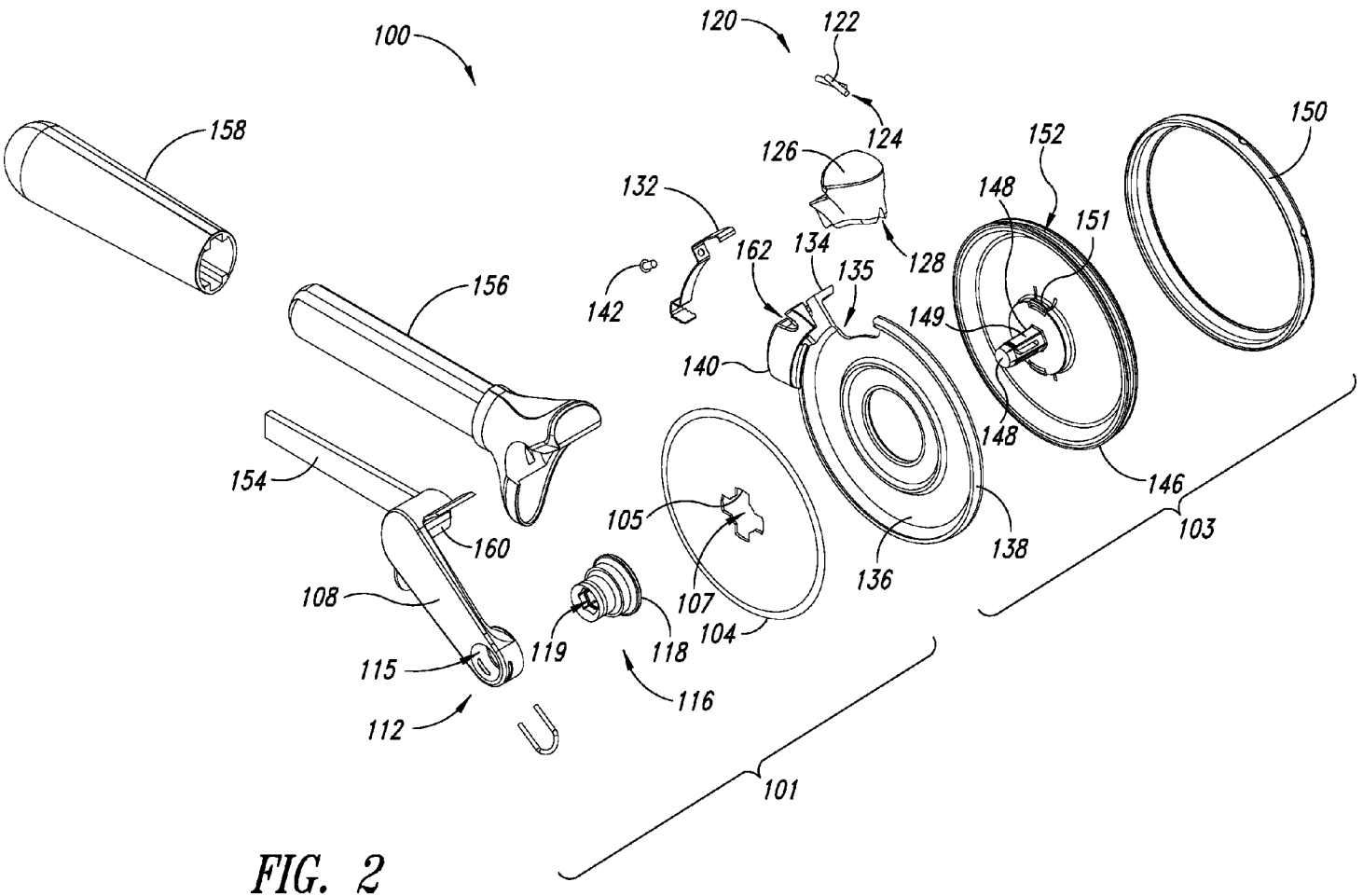
FIG. 2 illustrates an exploded isometric view of a cutting device according to one embodiment.

As shown in the illustrated embodiment of FIG. 2, the first coupling member 116 can include a hub element 118 configured to be rotatably mounted to one of the arm 108 and blade element 104. Some embodiments may include any suitable coupling member that rotatably mounts the blade element to the arm, such as bearings or other suitable rotatable couplings.

As illustrated in FIG. 1A, in one embodiment, the sharpening assembly 103 (FIG. 1B) can be selectively and removably coupled to the cutting assembly 101 when it is desired to sharpen the blade element 104 and/or to protect the blade element 104 or reduce the possibility of injury when storing or transporting the cutting device 100. As illustrated in FIG. 2, in one aspect, the sharpening assembly 103 of the cutting device 100 includes at least one sharpening tool 120 that can be selectively actuated by the user to sharpen the blade element 104. For example, in one embodiment, the sharpening tool 120 can be moved between at least a first position in which the sharpening tool 120 is spaced from the blade element 104, and a second position in which the sharpening tool bears against or contacts the blade element 104 adjacent and/or at the cutting edge 106. Therefore, when in the second position, the sharpening tool 120 can sharpen the cutting edge 106 when the blade element 104 is rotated. Accordingly, the user can easily and expediently roll and/or rotate the blade element 104 while the cutting edge 106 is sharpened without the awkwardness of having to hold the blade element or the tediousness of sharpening small sections of the cutting edge one section at a time The sharpening tool 120 can be made from any suitable wear resistant and/or sharpening material, and/or may include a textured surface to aid sharpening the cutting edge. For example, the sharpening tool can be made from a material including at least one of a carbide, a metal such as a steel alloy, diamond and/or metallic granules, or other suitable materials, textures or abrasives.

Furthermore, the sharpening tool 120 can include any suitable shape, in some embodiments, conforming to, complementing, and/or guiding at least a portion of the blade element 104 proximate its cutting edge 106. For example, the sharpening tool can include a diverging notch configured to receive the cutting edge 106. In the illustrated embodiment of FIG. 2, the sharpening tool 120 includes two rods 122 angularly positioned with respect to each other, forming a sharpening crevice 124 therebetween configured to receive the cutting edge 106. The angle between the rods 122 can be designed or configured to obtain desired results based on the dimensions and/or shape of the blade element 104. The sharpening tool 120 can be movably coupled with respect to the blade element 104 in any suitable manner.

Figure 3A:
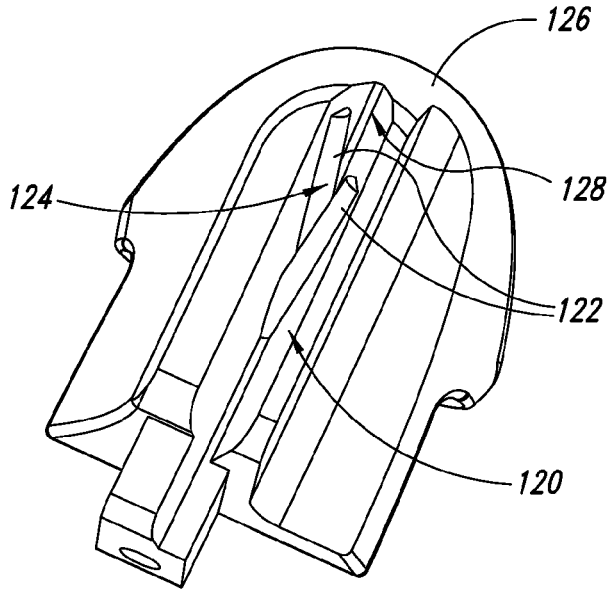
FIG. 3A illustrates a bottom isometric view of an actuator and sharpening tool of a cutting device according to one embodiment.
Figure 3B:
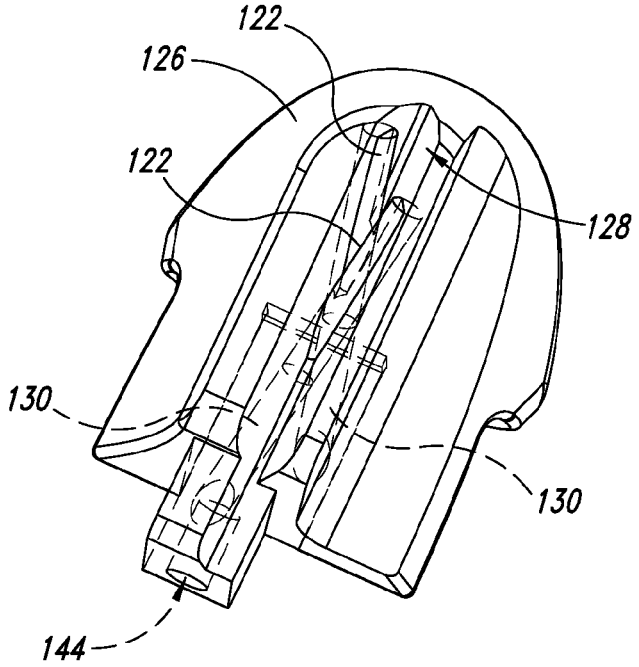
FIG. 3B illustrates another bottom isometric view of an actuator and sharpening tool of a cutting device according to one embodiment, with internal components shown in broken line.
Figure 3C:
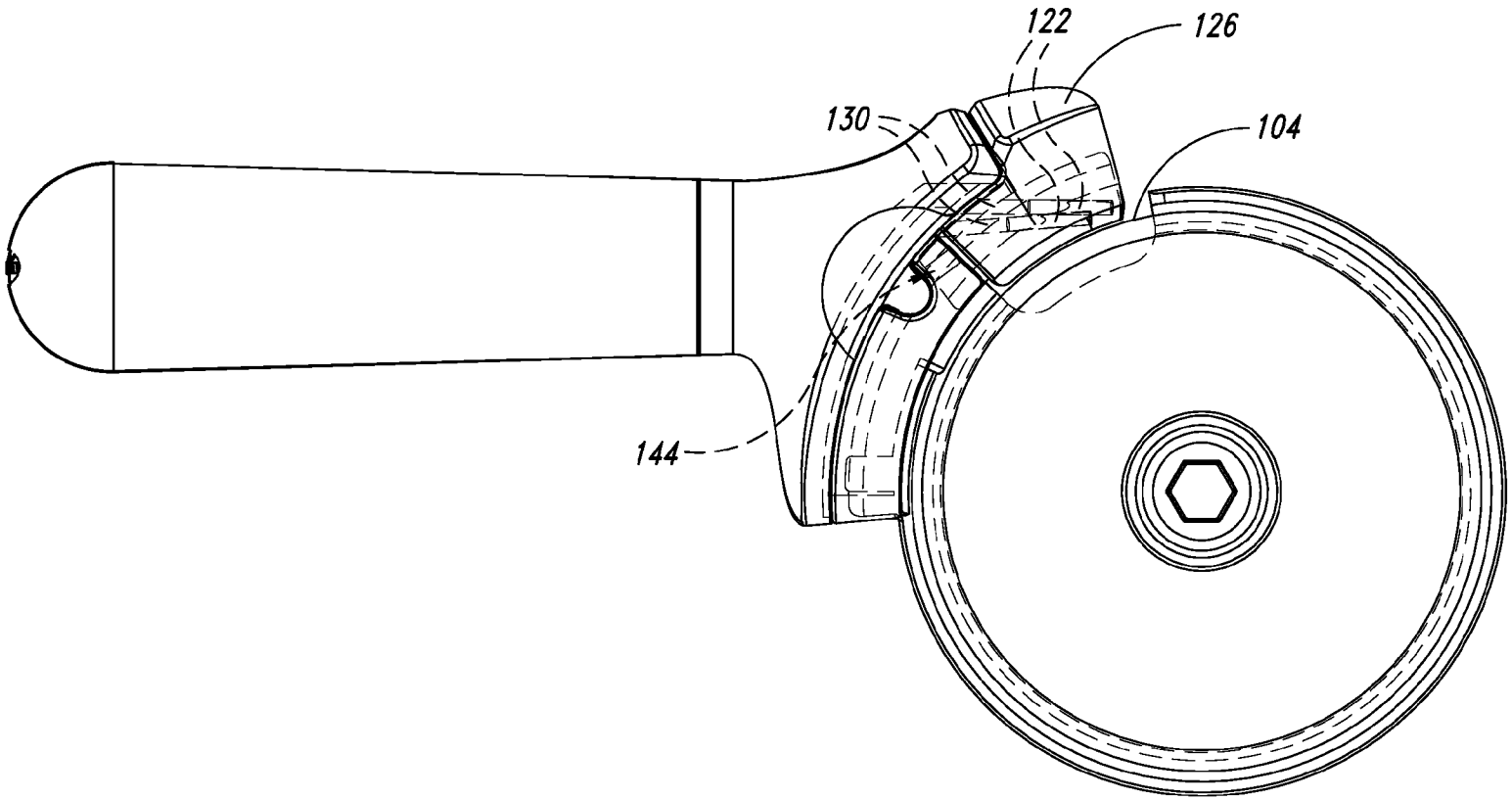
FIG. 3C illustrates a side view of a cutting device according to one embodiment, with internal components of an actuator shown in broken line.

In one embodiment, the sharpening assembly 103 includes an actuator 126 that is movably mounted with respect to the body 102 and/or the blade element 104 and that facilitates moving the sharpening tool 120 between the first and second positions. In one aspect, the actuator is positioned so that it can be easily accessed and actuated, for example, thumb actuated, while the user grips the handle 114 or other portion of the body 102. The actuator 126 can include at least one coupling feature that retains the sharpening tool 120. For example, FIGS. 3A, 3B, and 3C illustrate an arrangement of the actuator 126 and sharpening tool 120 according to one embodiment. As illustrated in FIG. 3A, a portion of the rods 122 at least partially forming the sharpening crevice 124 can be exposed, for example, in a blade receiving recess or notch 128 formed in the actuator 126.

The actuator 126 is illustrated in FIGS. 3B and 3C with internal components shown in broken line for clarity of description and illustration. As shown in these figures, the actuator 126 can include mounting features 130, such as a receptacle, hollow cylinder, detent mechanism, or other suitable structure or space, each configured to removably receive the respective rods 122. FIG. 3C illustrates the blade element 104 with respect to the actuator 126 when the sharpening tool 120 (e.g. rods 122) is in the first position, spaced from the blade element 104.

In one embodiment, the actuator 126 can be coupled to the body 102, or with respect to the body 102, in a resilient manner, or other movable manner, that allows the user to push, press, or otherwise move or actuate the actuator 126 to selectively move the sharpening tool 120 between the first and second positions.

In one embodiment as illustrated in FIG. 2, the actuator 126 can be movably coupled with respect to the body 102 via a biasing member 132. In one aspect, the biasing member 132 can include a leaf spring. Other suitable biasing members and resilient and/or elastically deformable coupling members are contemplated to be within the scope of the present disclosure.

In one aspect, the device 100 includes an interface member 134 configured to partially house or otherwise secure the biasing member 132. The interface member 134 can be fixed in position with respect to the body 102 when coupled to a portion of the device 100. For example, the interface member 134 can be removably coupleable to the body 102, to the hub element 118, and/or the arm 108. The interface member 134 can include an interface body 136, an interface flange 138 formed toward a periphery of the interface body 136, and a housing 140 configured to secure at least a portion of the biasing member 132. The interface member 134 and/or a portion thereof, such as the interface flange 138 can be spaced from the cutting edge 106 to facilitate smooth rotation of the blade element 104 and prevent contact of the blade from surrounding structure during sharpening of the cutting edge 106.

It is contemplated, however, that in some embodiments, an inner portion of the interface flange may include one or more continuous or spaced sharpening tools that contact the blade element 104 at or adjacent the cutting edge 106.

Figure 4A:
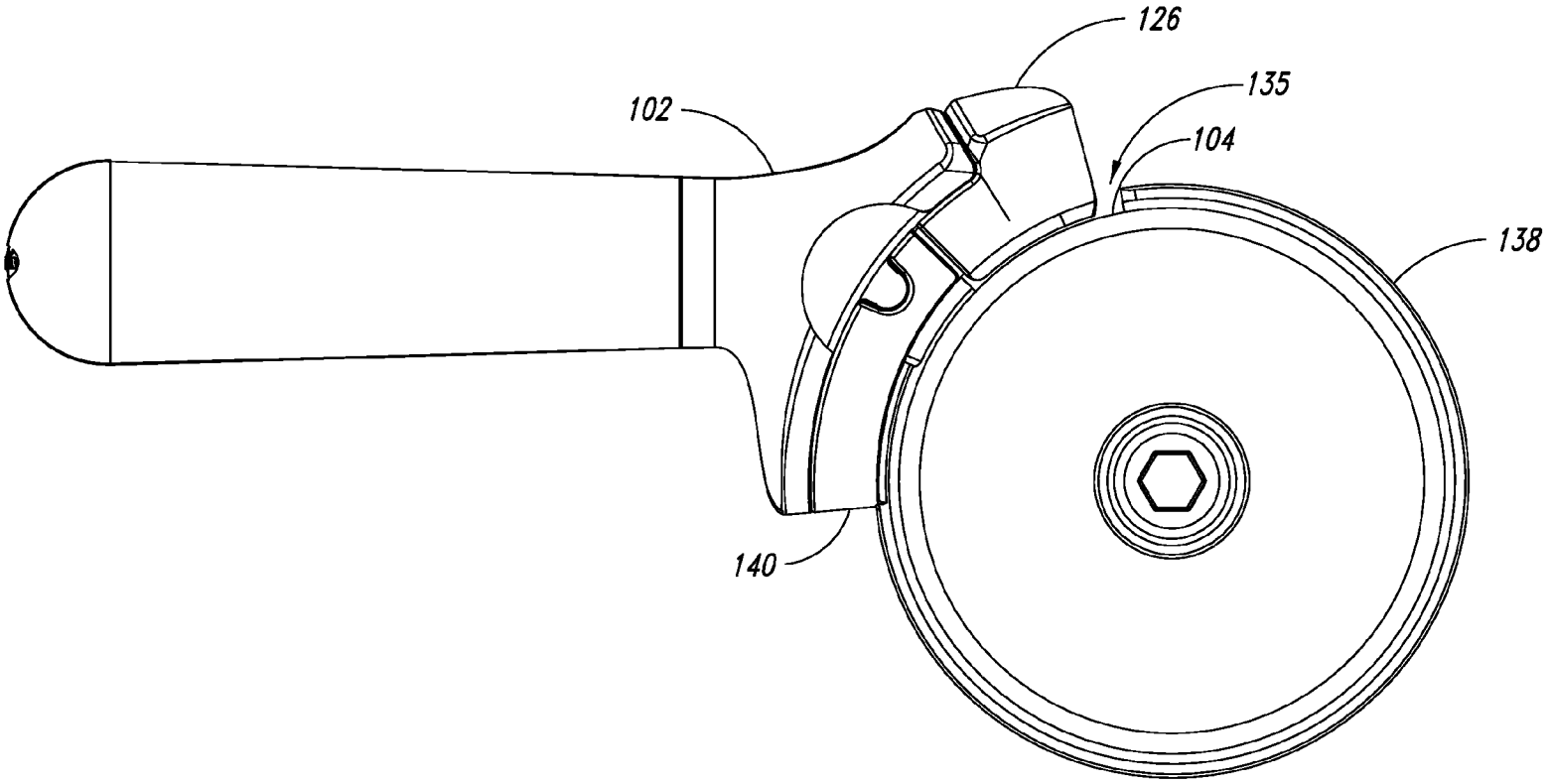
FIG. 4A illustrates a side view of an actuator, blade element, actuator and/or blade interface member, and a portion of a body of a cutting device according to one embodiment.
Figure 4B:
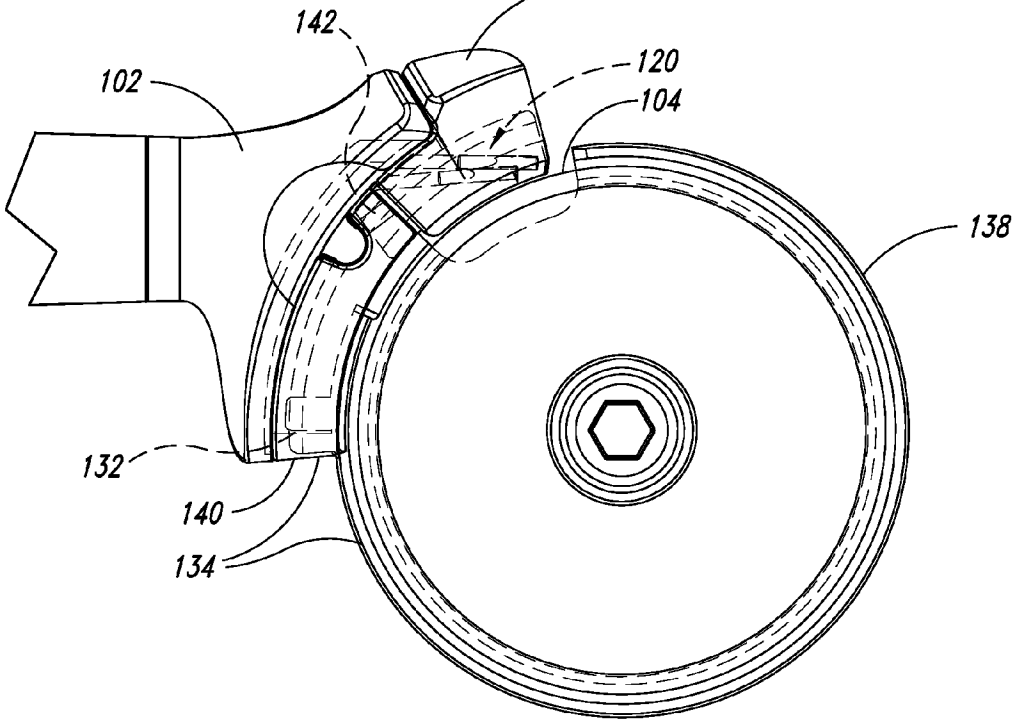
FIG. 4B illustrates a side view of an actuator, blade element, actuator/blade interface member, and a portion of a body of a cutting device according to one embodiment, with some internal components shown in broken line.

FIGS. 4A and 4B illustrate a portion of the device 100 including the body 102, the blade element 104, the interface member 134, and actuator 126. In FIG. 4B, internal components of the actuator 126 and interface member 134 are illustrated in broken line for clarity of description and illustration, and to make visible the biasing member 132 and sharpening tool 120.

As shown in FIG. 4B, a portion of the biasing member 132 can extend out from the housing 140 of the interface member 134 and be coupled to the actuator 126, for example via a fastening element 142, such as a rivet or other suitable fastener or coupling feature. In one aspect, as illustrated in FIG. 3B, the actuator includes a biasing member coupling feature 144, such as a recess, a receptacle, a detent mechanism, a cylindrical hollow, or any other suitable structure or space, configured to receive or be otherwise coupled to the fastening element 142.

Therefore, when the user pushes, presses, or otherwise actuates the actuator 126, the biasing member 132 resiliently deflects or deforms to bring into contact the sharpening crevice 124 (FIG. 3A) with the blade element 104 toward the cutting edge 106. When the user releases the actuator 126, the biasing member 132 biases, or reverts to its original position to move, the actuator 126 and sharpening tool 120 away from the blade element 104 or cutting edge 106, allowing the blade element 104 to rotate freely for cutting or slicing the substrate or food item.

In one aspect, as shown in FIG. 4A, the interface member 134 can include an access space 135, such as a recess or cavity, that is positioned proximate the actuator 126 when sharpening is being performed to facilitate movement of the actuator toward the cutting edge 106 of the blade element 104.

In one embodiment illustrated in FIG. 2, the cutting device 100 includes a blade cover, guard, or protector, or rolling adaptor 146 (hereinafter "rolling adaptor" for clarity of description) that facilitates rotation or rolling of the blade element 104 when sharpening the cutting edge 106 without the blade element 104 or any portion thereof contacting a rolling substrate, which during sharpening can include any surface (not shown). This helps keep the cutting edge clean during sharpening and prevent premature dulling of the cutting edge 106 after sharpening and before the next intended substrate or food item cutting operation.

Depending on the manner of coupling of the interface member 134, the rolling adaptor 146 can also assist in retaining the interface member 134 when sharpening the cutting edge 106.

In one embodiment, the rolling adaptor 146 is configured to be rotatably coupled with respect to the body 102 or other portion of the device 100 to rotate with the blade element 104. For example, as illustrated in FIG. 2, in one aspect, the rolling adaptor 146 includes a coupling protrusion 148 configured to be coupled to the hub element 118. As the rolling adaptor 146 rotates, the hub element 118 rotates, therefore, rotating the blade element 104. When the actuator 126 is pressed or otherwise actuated to position the sharpening tool 120 in the second position, the user can roll the rolling adaptor 146 on the surface, for example in a back and forth motion, to expediently and easily sharpen the cutting edge 106 without the cutting edge 106 contacting the surface.

Figure 6:
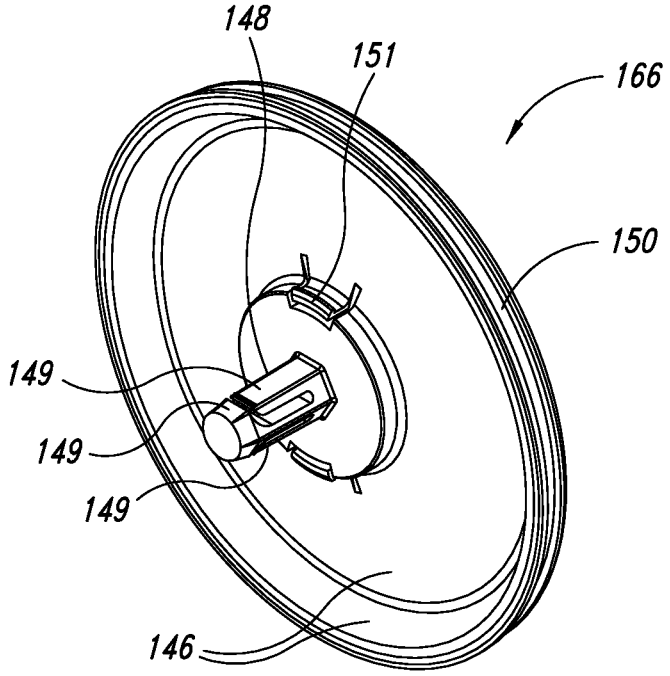
FIG. 6 illustrates a rolling assembly including a blade guard or rolling adaptor and a grip member or ring of a cutting device according to one embodiment.

As illustrated in FIGS. 2 and 6, the coupling protrusion 148 can include at least one guiding or coupling feature 149, such as a detent mechanism and/or resilient member or members, operable to resiliently or elastically deform and snap against complementary features in a bore 119 of the hub element 118 (FIG. 1A). In some embodiments, the bore 119 of the hub element 118 and a bore 115 of the arm 108 that receives the hub element 118 can both be through-bores, providing access to an end of the coupling protrusion 148 of the rolling adaptor 146 to permit the user push the protrusion 148 and disengage or remove the rolling adaptor 146.

In some embodiments, as illustrated in FIGS. 2 and 6, the rolling adaptor 146 can include grip members 151 configured to be removably coupled to a complementary feature 105, for example formed in a bore 107, of the blade element 104 to facilitate or assist in rotating the blade element 104. The grip members 151 can include a detent mechanism and/or resilient member configured to deform and resume its original position to grip the feature 105 of bore 107 in the blade element 104.

In one aspect, the sharpening assembly 103 includes a grip member or ring 150 (hereinafter "grip member" for clarity of description) configured to be removably coupled to the rolling adaptor 146. For example, the rolling adaptor 146 can include a recess 152 formed on a periphery or circumference thereof and configured to receive the grip member 150. In some embodiments, the grip member 150 can be smaller than the rolling adaptor 146 and made from a flexible, elastic, or resilient, or otherwise stretchable, material, so that it can stretched to fit over the edge of the recess 152 and contract to be securely received in the recess 152.

The grip member 150 can be selectively and removably coupleable to the rolling adaptor 146, and can be fabricated from a material that facilitates efficient and non-slip rolling of the grip member 150 on the surface. For example, the grip member 150 can be fabricated from a material including rubber, foam, silicone, plastics, other polymeric material, or any other suitable material. This further facilitates fabricating the rolling adaptor 146 from a material that may be better suited for being coupled to the hub element 118. For example, the rolling adaptor 146 can be fabricated from a material with dimensional stability qualities, such as a Polyoxymethylene plastic (POM).

It will be appreciated that the particular coupling configuration, or intercoupling, of components can be varied in different embodiments without departing from the scope of the present disclosure.

For example, as shown in the illustrated embodiment of FIG. 2, the arm 108 can include a coupling extension 154 and the body 102 can include a body handle portion 156, both of which are securely received or fitted in a handle cover 158. The handle cover 158 can be fabricated from a material that aids gripping the handle 114 (FIG. 1A). For example, the handle cover 158 can be fabricated from a material including a rubber, foam, silicone, plastic, or any other suitable material such as a thermoplastic elastomer (TPE).

In one aspect, the arm 108 can include a first aligning and/or barrier feature 160 (hereinafter "first aligning feature" for clarity of description) and the interface member can include a second aligning and/or barrier feature 162 (hereinafter "second aligning feature" for clarity of description), which can have a complementary or conforming shape or configuration with respect to the first aligning feature 160. For example, the first aligning feature 160 can include a protuberance and the second aligning feature 162 can include a cavity, recess, or other suitable void.

Figure 5:
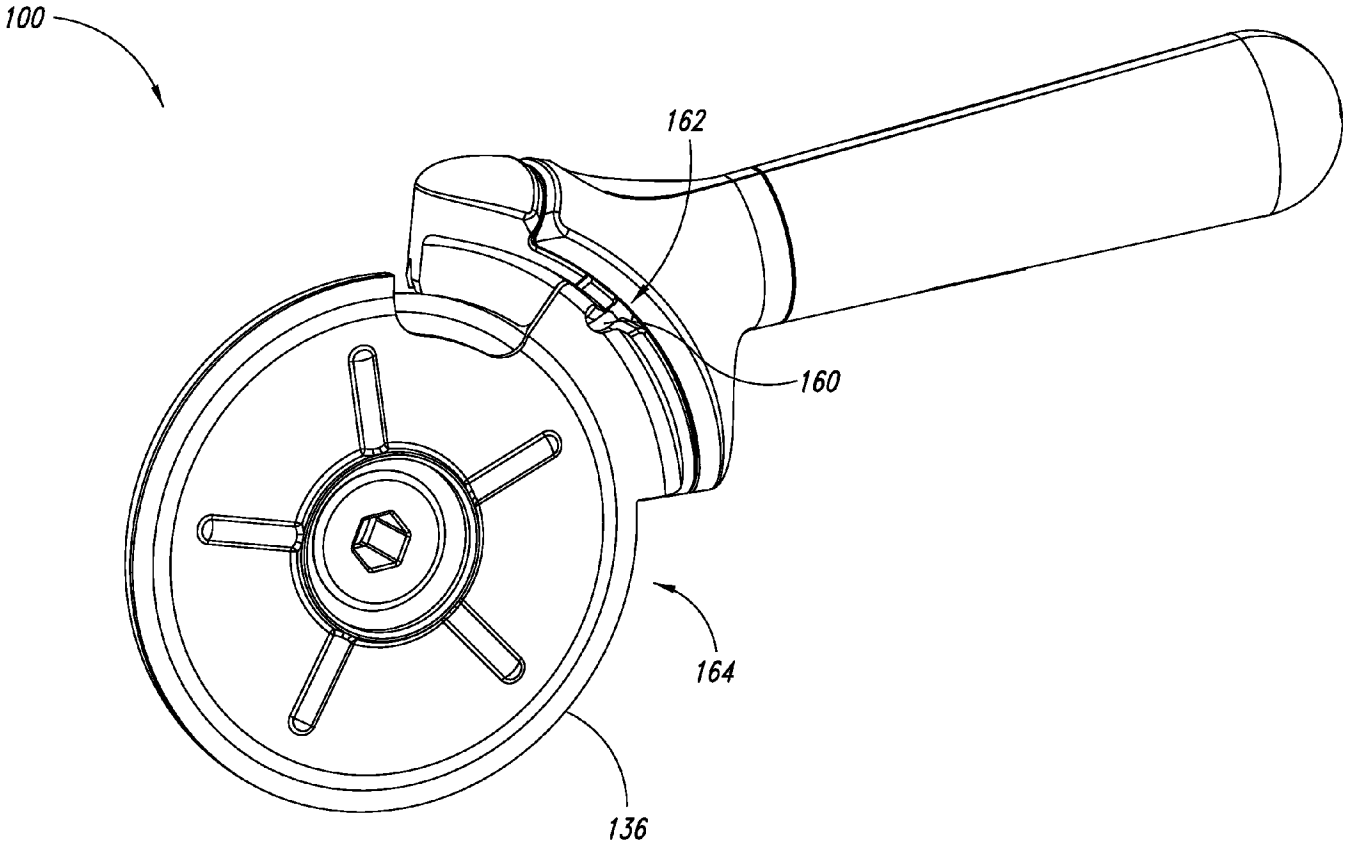
FIG. 5 illustrates a side isometric view of a body, handle, blade element, actuator, and actuator/blade interface of a cutting device according to one embodiment.

FIG. 5 illustrates a portion of the cutting device 100 according to one aspect, without showing the rolling adaptor 146 and with at least a portion of the body 102 transparently shown for clarity of illustration and description. The first and second aligning features 160, 162 are shown fitted with respect each other. These or other aligning features in other embodiments can assist in expedient assembly, disassembly, and/or proper positioning of the interface member and/or the actuator.

In some embodiments, the interface member 134 and the actuator 126 can be part of a sharpening preassembly 164. In such embodiments, the user can easily and expediently couple the sharpening preassembly 164 when it is desired to sharpen the cutting edge 106 of the blade element 104.

As illustrated in FIG. 6, in some embodiments, the rolling adaptor 146 and grip ring 150 can also be preassembled and either fixedly or removably coupled to each other and forming a rolling preassembly 166. This configuration facilitates easy coupling of the rolling adaptor 146 and grip member 150 to efficiently roll the rolling preassembly 166 on the surface and sharpen the cutting edge 106.

Furthermore, in embodiments that include at least one of the blade receiving recess 128 in the actuator 126, and the interface flange 138 toward the periphery of the interface member 134, any debris generated due to sharpening of the cutting edge 106, can be collected and disposed after sharpening.

In other embodiments, the cutting device may include more or less features to achieve selective sharpening of the blade element. For example, the blade interface may be integrated with the actuator and a portion thereof can be fabricated from a material, or be sized, to facilitate selective and resilient movement of the actuator. For example, the actuator may extend from the body via a thin or resiliently formed or fabricated extension, allowing the user to move the actuator and position the sharpening tool in the first and/or the second positions.

Figure 7:
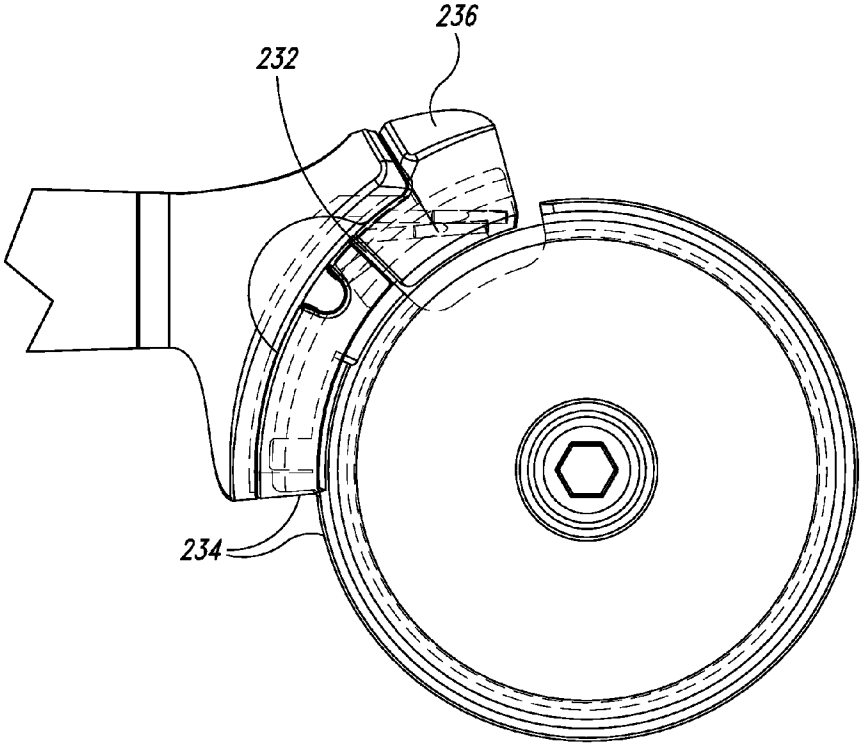
FIG. 7 illustrates an actuator and interface member of a cutting device with a resilient member therebetween, according to one embodiment, with some internal components shown in broken line.

In some embodiments, as illustrated in FIG. 7, an actuator 236 can be coupled to an interface member 234 via a resilient member 232, such as an elastically deformable plastic or thin metal or other suitable material or shape that permits the actuator 236 to be moved toward a cutting edge of a blade element when pressed or otherwise actuated, and away from the cutting edge of the blade element when released.

Other suitable actuation methods, features, and/or structures to move the sharpening tool to the first and second positions are contemplated to be within the scope of the present disclosure. For example, instead of, or in addition to, the handle, the cutting device may include an integrated or selectively and removably coupleable grip member configured or adapted to conform to a palm of a user. In such an embodiment, the handle and grip member can be both coupled to the body or be removably and replaceably mountable to switch between cutting and sharpening modes. The grip member can be adjacent or integrated with the actuator so that palming the grip member and pressing down actuates the sharpening tool.

It will also be appreciated that in embodiments that include removable components, these components can be easily removed for cleaning and/or replacement. For example, the grip member 150 can be cleaned and/or replaced when dirty and/or worn; and/or the sharpening tool 120 can be removed and cleaned, reoriented, and/or replaced, if needed. Other components if present can also be removed and cleaned and/or replaced or repaired as needed or desired.

Some embodiments may include other features or manner of actuating the corresponding sharpening tool or tools. For example, an actuator can be eliminated and the sharpening tool can be coupled to a portion of the body, or an actuator may be present and coupled to the sharpening tool, while exerting a force on the handle moves the sharpening tool toward the cutting edge of the blade element. A stop member can be incorporated and be selectively movable between a first position in which it blocks movement of the handle (e.g. to allow free rotation of the blade element) and a second position in which it allows handle to move toward the blade element (e.g. to move sharpening tool toward the cutting edge).

In some embodiments, in addition or instead of the sharpening rods, inner surfaces of the blade receiving recess or notch (e.g. recess 128 in illustrated embodiment shown in at least FIGS. 2-3C) can include abrasive granules, such as fine granules, which can be diamond, metal, or other wear resistant material or powder, for sharpening the cutting edge. The portion of the actuator or sharpening tool including such a recess can be a separate and removably coupleable component to facilitate easy cleaning, repair, and/or replacement of this component. Other suitable modifications, combinations, and/or elimination and/or addition of features that cooperate to set forth a cutting device that facilitates selective sharpening of the corresponding blade element via direct or assisted rolling of the blade element, are contemplated to be within the scope of the present disclosure.

Some embodiments may include an adjustable arm that can accommodate multiple size blades. Other components can also be adjustable to suit various blade sizes.

It is also contemplated that some embodiments may include electronic and/or motorized components that can be selectively actuated, for example, to move the sharpening tool and/or rotate the blade element during sharpening of the cutting edge thereof. For example, the rolling adaptor can be a rotating adapter, which is motor actuated to rotate it while the sharpening tool is held in the second position to sharpen the cutting edge. Some embodiments may include electronic circuitry to automatically initiate actuation of the rotating adaptor when the actuator is moved toward the cutting edge.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A cutting device comprising:

a body;

a blade element having a cutting edge and being rotatably mounted with respect to the body;

a sharpening tool configured to be coupled to the body, the sharpening tool being selectively movable between a first position in which the sharpening tool is spaced from the blade element and a second position in which the sharpening tool contacts the blade element at or adjacent the cutting edge, the sharpening tool sharpening the cutting edge when in the second position and the blade element is rotated;

an actuator selectively movable to position the sharpening tool in at least one of the first and second positions;

an interface member configured to be coupled to the body, the interface member including an interface flange positioned proximate at least a portion of the cutting edge of the blade element and spaced therefrom when the interface member is coupled to the body; and a biasing member coupling the interface member to the actuator and configured to permit selective movement of the actuator with respect to the interface member to position the sharpening tool in the second position, and to return the sharpening tool to the first position when the actuator is released.

2. The cutting device of claim 1, further comprising:

a rolling adaptor configured to be coupled to the blade element to rotate therewith, and to be selectively rolled on a surface or rotated when the sharpening tool is in the second position to sharpen the cutting edge.

3. The cutting device of claim 2, further comprising:

a grip member coupled to a circumference of the rolling adaptor and configured to assist in rolling or rotation of the rolling adaptor.

4. The cutting device of claim 1, further comprising:

an arm member rotatably coupling the blade element to the body; and a handle coupled to or extending from the body and configured to adapt or conform to a grip of a user.

* * * * *